US006716325B2

(12) United States Patent
Bentley

(10) Patent No.: US 6,716,325 B2
(45) Date of Patent: Apr. 6, 2004

(54) ELECTROLYTIC CELL FOR HYPOCHLORITE GENERATION

(76) Inventor: Malcolm Barrie Bentley, 602 N. Highland St., Napannee, IN (US) 46550

( * ) Notice: Subject to any disclaimer, the term of this patent is extended or adjusted under 35 U.S.C. 154(b) by 149 days.

(21) Appl. No.: 09/993,423

(22) Filed: Nov. 14, 2001

(65) Prior Publication Data

US 2002/0056635 A1 May 16, 2002

(30) Foreign Application Priority Data

Nov. 15, 2000 (AU) ..... PR1463

(51) Int. Cl.[7] ..... C25B 9/00; B23H 3/04

(52) U.S. Cl. ..... 204/272; 204/278.5; 204/267; 204/286.1

(58) Field of Search ..... 204/278.5, 267, 204/272, 286.1, 288.1

(56) References Cited

U.S. PATENT DOCUMENTS 4,173,525 A * 11/1979 Nakamatsu et al. ..... 204/278.5

* cited by examiner

*Primary Examiner*—Patrick Ryan
*Assistant Examiner*—Thomas H. Parsons
(74) *Attorney, Agent, or Firm*—Duane Morris LLP

(57) ABSTRACT

An electrolytic cell including a plurality of electrodes arranged to define a plurality of channels between adjacent electrodes is disclosed. Each channel is in fluid communication adjacent a first end with a first adjacent channel and is in fluid communication adjacent a second end with a second adjacent channel.

10 Claims, 10 Drawing Sheets

ELECTROLYTIC CELL FOR HYPOCHLORITE GENERATION

BACKGROUND OF THE INVENTION

The present invention relates to an electrolytic cell for hypochlorite generation.

In line hypochlorination by using sea water or adding sodium chloride, NaCl, to fresh water to chlorinate cooling systems is commonly used in industrial plants and power stations throughout the world. For these systems sodium hypochlorite is derived from the chloride ion in sea or salty water when it is passed through an electrolytic cell or cells. Generally, sodium hypochlorite is produced by hypochlorite generators situated close to the cooling water intake structures of industrial plants and power stations to inject sodium hypochlorite into the cooling water system.

The object for injecting sodium hypochlorite into the industrial water systems is to keep algae and mussel growth from clogging heat exchangers and generator condensers in order to keep plant efficiency at maximum. If heat exchangers and condensers are allowed to build up with algae and mussel growth, the rate of heat exchange becomes inefficient and machinery and equipment can overheat and break down. For this reason it is imperative to keep the cooling water free from any growth that could impede the flow of water in cooling water systems.

In-line sodium hypochlorite generators receive a supply of salty water, either directly from the ocean or from fresh water salted with NaCl generally at a chloride concentration of about 19,000 mg/liter of $Cl^-$ and circulate it through an electrolytic cell or cells to provide a sodium hypochlorite solution of up to 2400 mg/liter. Dilute seawater from estuaries or other locations is usable, providing the dilution with fresh water is not excessive and a low concentration of sodium hypochlorite is required.

When salty water is passed between an inert anode and a cathode electrolyzed with a dc voltage, sodium hypochlorite is evolved at the positive anode and gaseous hydrogen at the negative cathode.

In line hypochlorite generators using sea or salty seawater can become inefficient due to calcareous and magnesium deposits on the cathode. While this can be minimized utilizing high flow rates around the electrodes, periodic flush through cleaning must be used to keep the cell generating efficiently. Flushing with dilute hydrochloric acid is employed to clean the cell and maximize the efficiency.

The existing electrolytic cells suffer from a number of disadvantages. Among these disadvantages are inefficiencies due to the cell design and the large physical size of the cell, which means that material costs are high and a heavy support structure is required, together with a greater quantity of copper busbars. This also has the effect that the cost of erection and transport is greater. Further disadvantages exist in that the equipment is generally workshop tested before transport, so it requires the equipment to be dismantled and packed after testing. The dismantling of such cells for inspection purposes is specialized and difficult and requires special tools and equipment. It is also common to require the complete cell to be returned to the vendor for refurbishment.

Other disadvantages exist in that wetted areas other than cathodes or anodes are of exotic metals and that the sodium hypochlorite generator has to be shut down for inspection and replacement of electrodes.

The present invention attempts to overcome at least in part some of the aforementioned disadvantages of previous electrolytic cells for hypochlorite generation.

SUMMARY OF THE INVENTION

In accordance with one aspect of the present invention there is provided an electrolytic cell including a plurality of electrodes wherein the electrodes are arranged such that a plurality of channels are defined by adjacent electrodes and each channel is in fluid communication adjacent a first end thereof with a first adjacent channel and is in fluid communication adjacent a second end thereof with a second adjacent channel.

BRIEF DESCRIPTION OF THE DRAWINGS

The present invention will now be described, by way of example, with reference to the accompanying drawings, in which.

DESCRIPTION OF THE INVENTION

Figure 1:
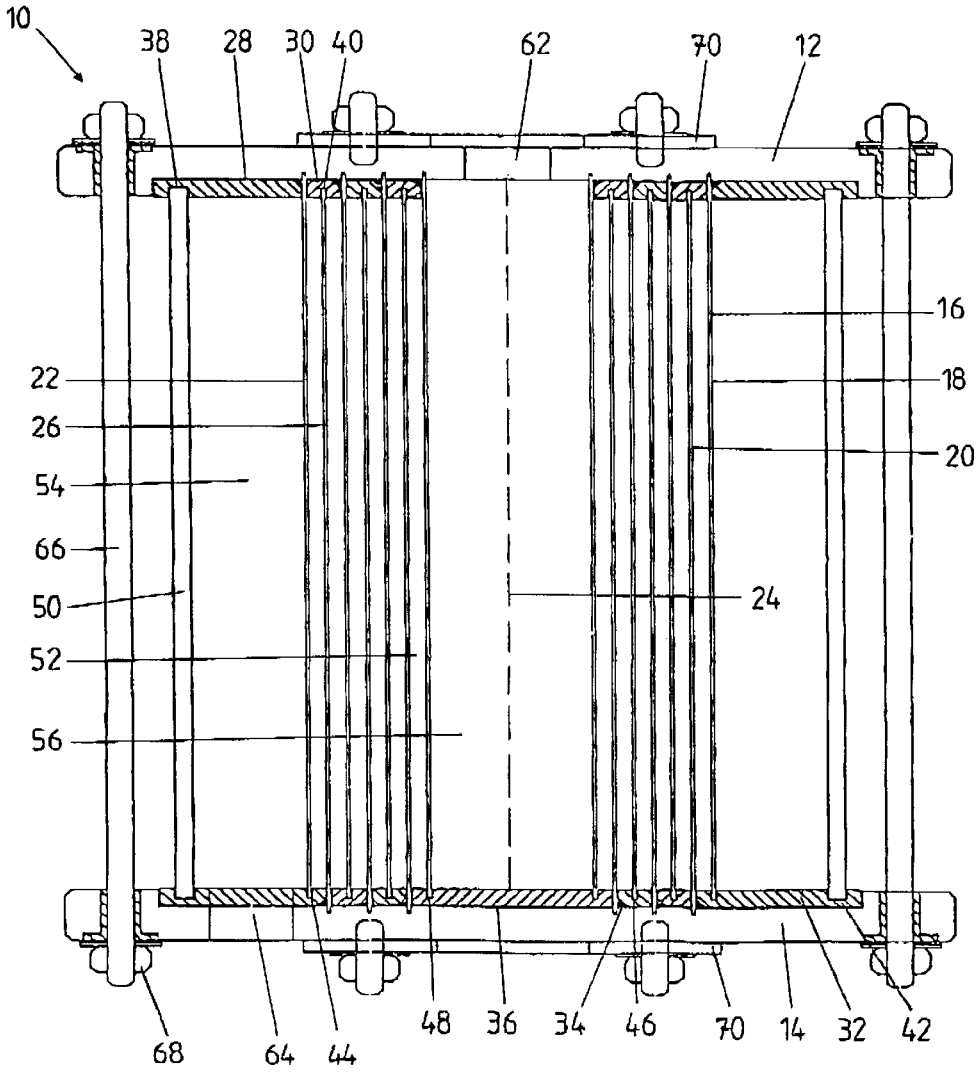
FIG. 1 is a side cross-sectional view of an electrolytic cell in accordance with the present invention.

Referring to the Figures, there is shown an electrolytic cell 10 for hypochlorite generation including a negative end flange member 12, a positive end flange member 14 and a plurality of electrodes 16. The electrodes 16 include at least one cathode 18 and at least one anode 20.

The cathodes 18 comprise a first series of tube members 22 of successively increasing radius. Each cathode 18 is secured at a first end thereof to the negative end flange member 12 about a central longitudinal axis 24 of the electrolytic cell 10. The cathodes 18 are secured to the negative end flange member 12 by any suitable means, such as by welding.

The anodes 20 comprise a second series of tube members 26 of successively increasing radius. Each anode 20 is secured at a first end thereof to the positive end flange member 14 about the central longitudinal axis 24 of the electrolytic cell 10. The anodes 20 are secured to the positive end flange member 14 by any suitable means, such as by welding.

The anodes 20 preferably consist of titanium, plated on inner and outer surfaces with oxides of the platinum group of metals. The cathodes 18 are preferably unplated titanium.

Figure 2:
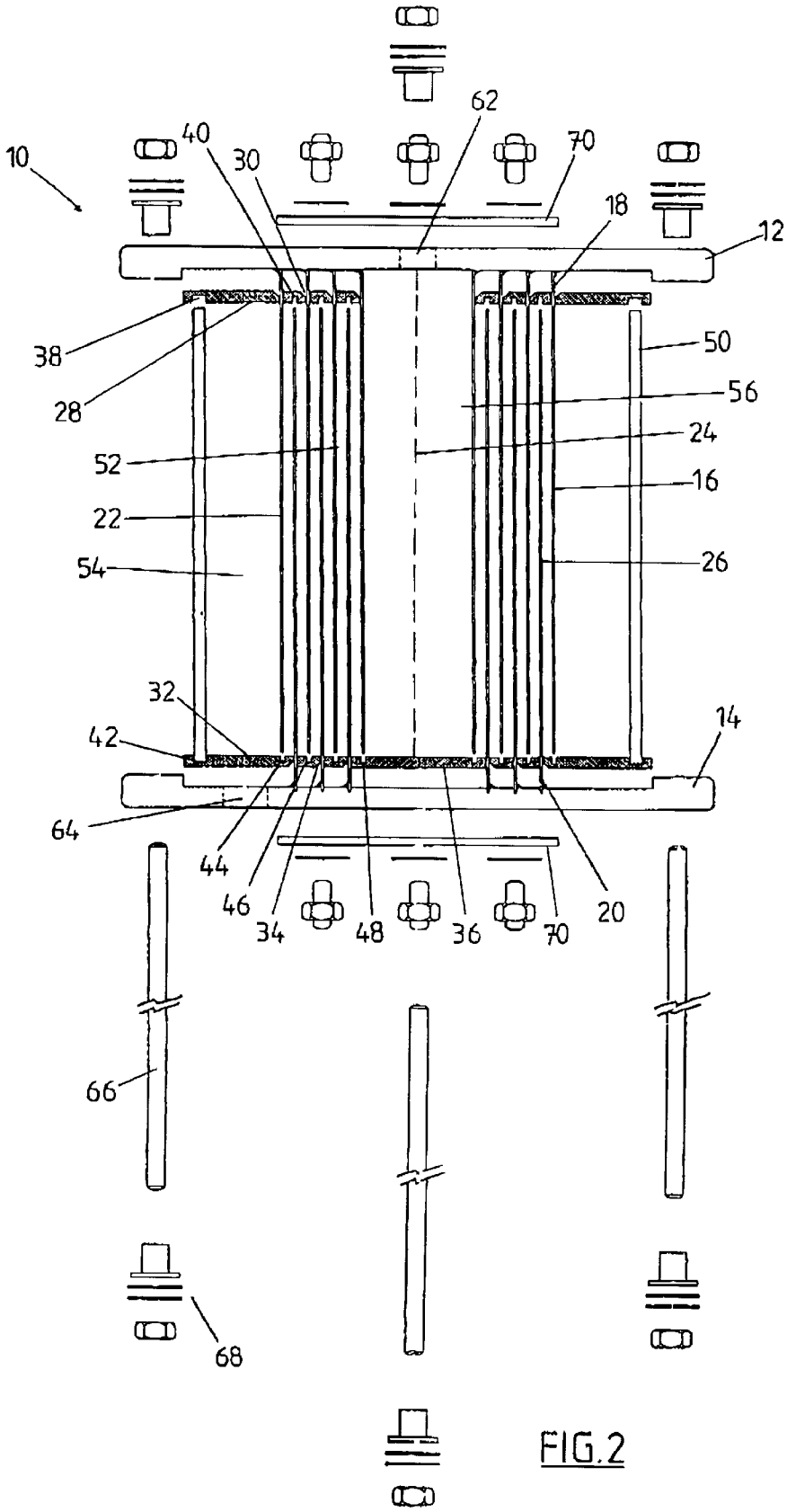
FIG. 2 is an exploded cross-sectional view of the electrolytic cell of FIG. 1.
Figure 3:
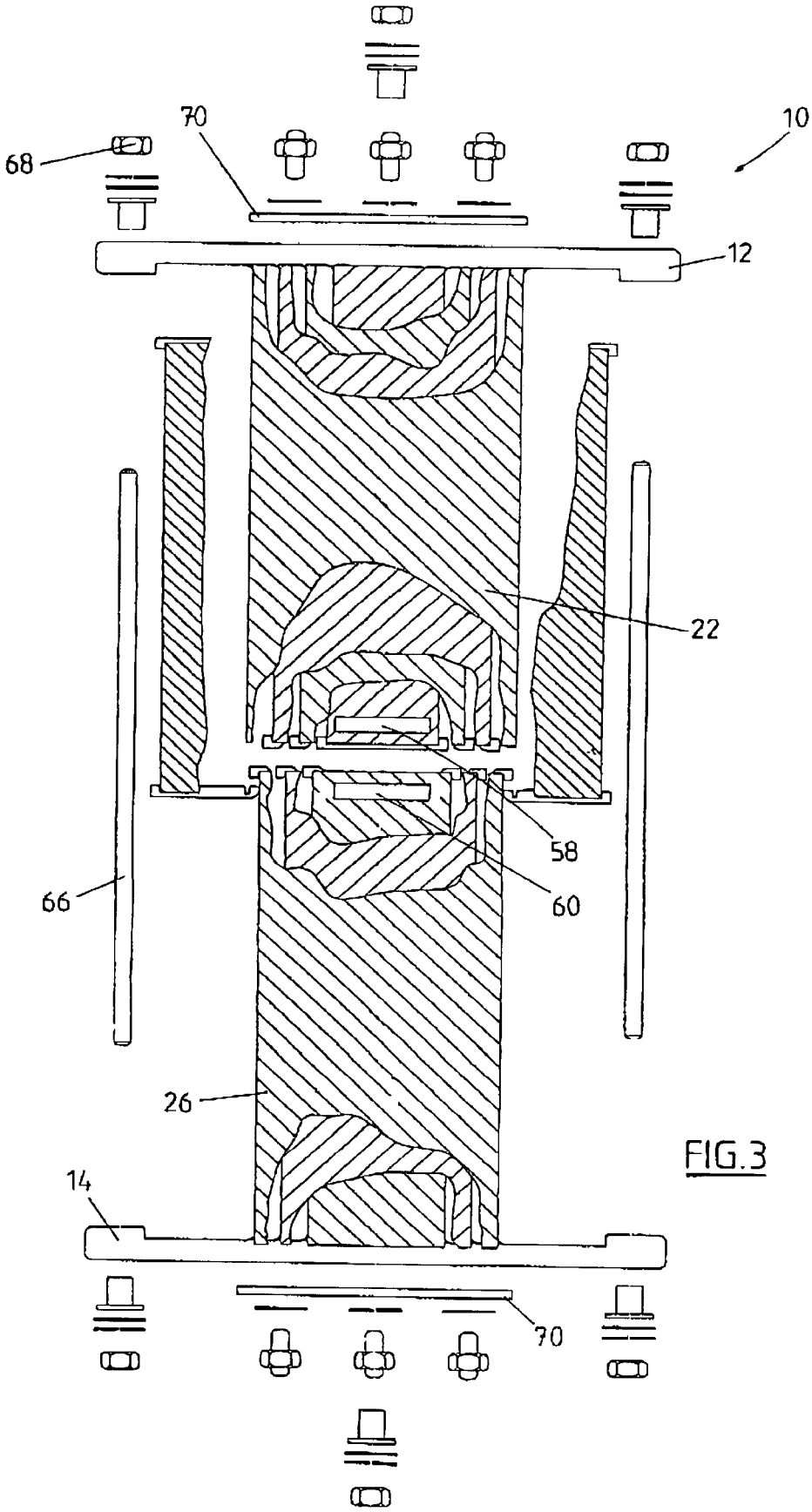
FIG. 3 is side view of the electrolytic cell of FIG. 1 shown partially exploded and having portions of the anodes and cathodes cut away.
Figure 4:
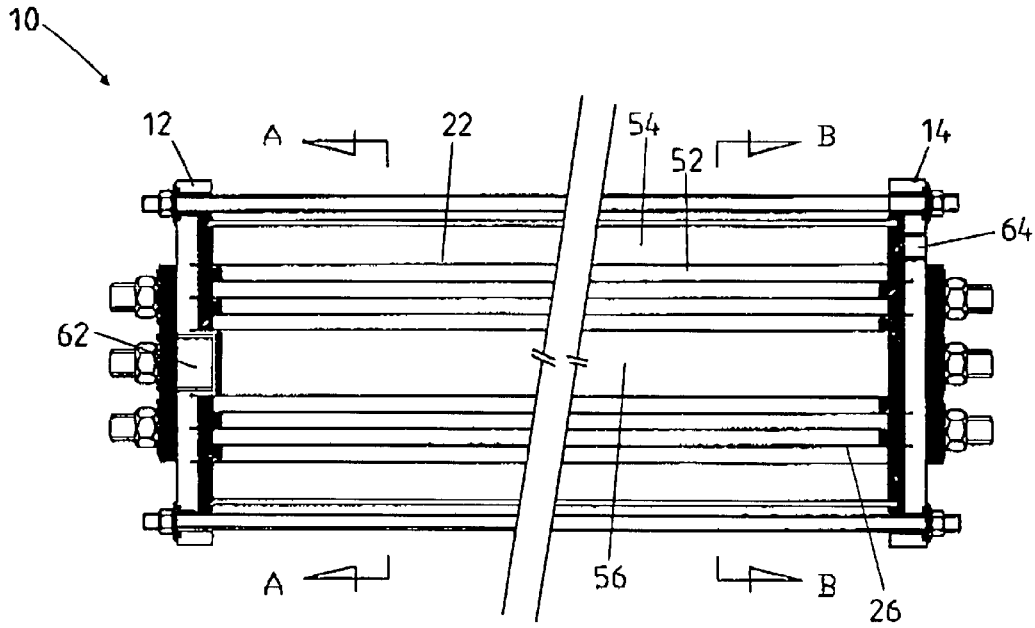
FIG. 4 is a side cross sectional view of an alternate embodiment of an electrolytic cell in accordance with the present invention having fewer anodes and cathodes.
Figure 5:
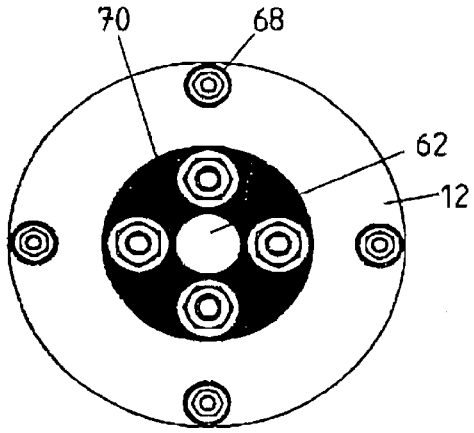
FIG. 5 is an end view of a first end of the electrolytic cell of FIG. 4.
Figure 6:
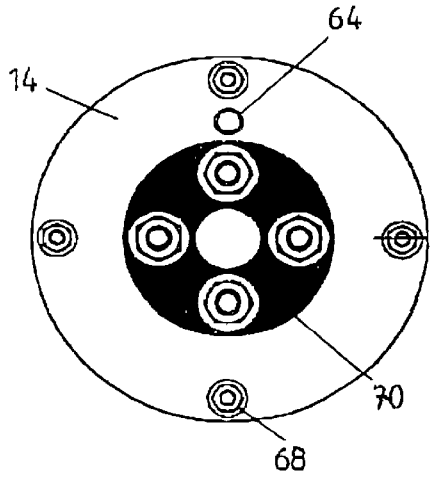
FIG. 6 is an end view of a second end of the electrolytic cell of FIG. 4.
Figure 7:
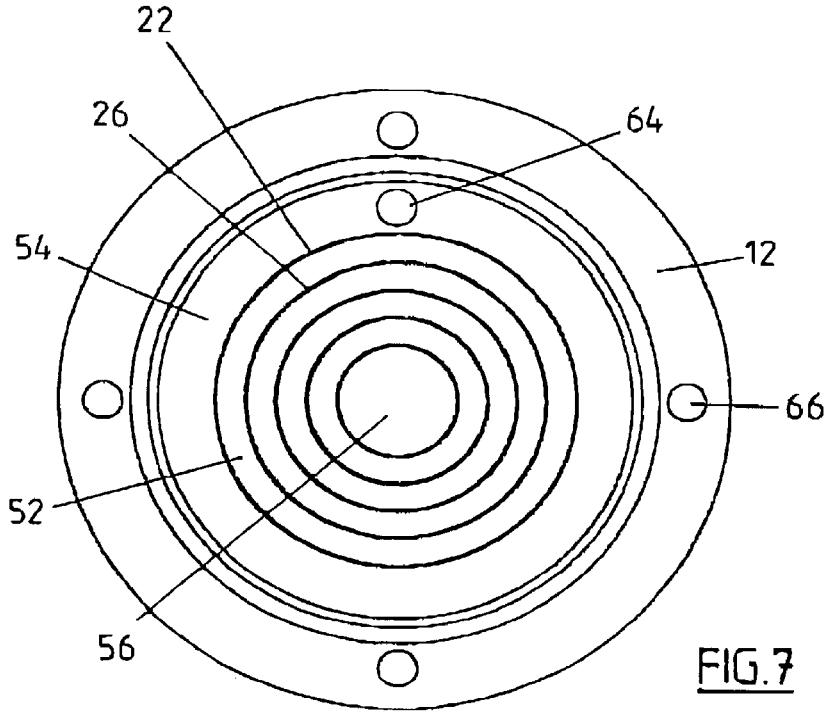
FIG. 7 is a cross-sectional view of the electrolytic cell of FIG. 5 cut through the line B—B.
Figure 8:
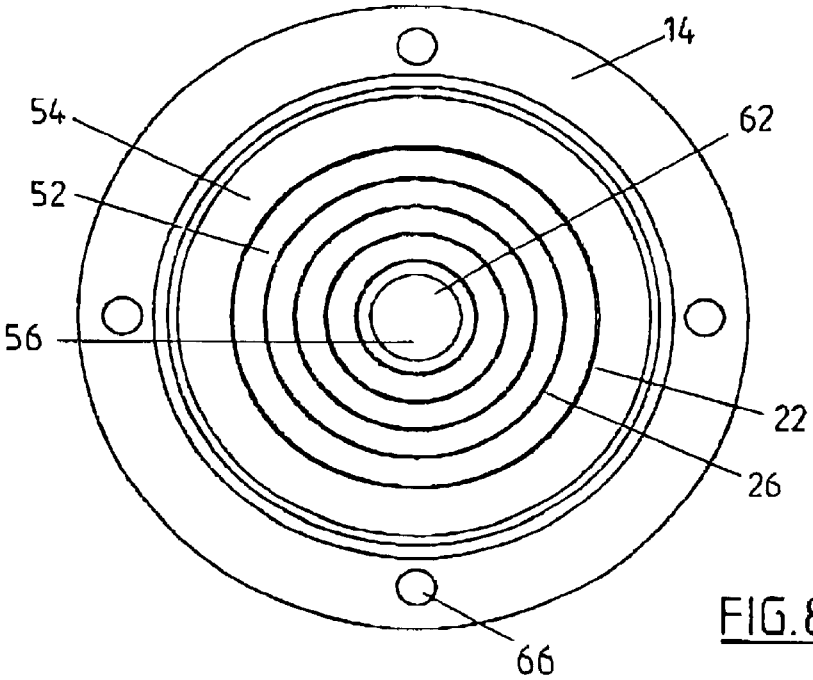
FIG. 8 is a cross-sectional view of the electrolytic cell of FIG. 5 cut through the line A—A.
Figure 9:
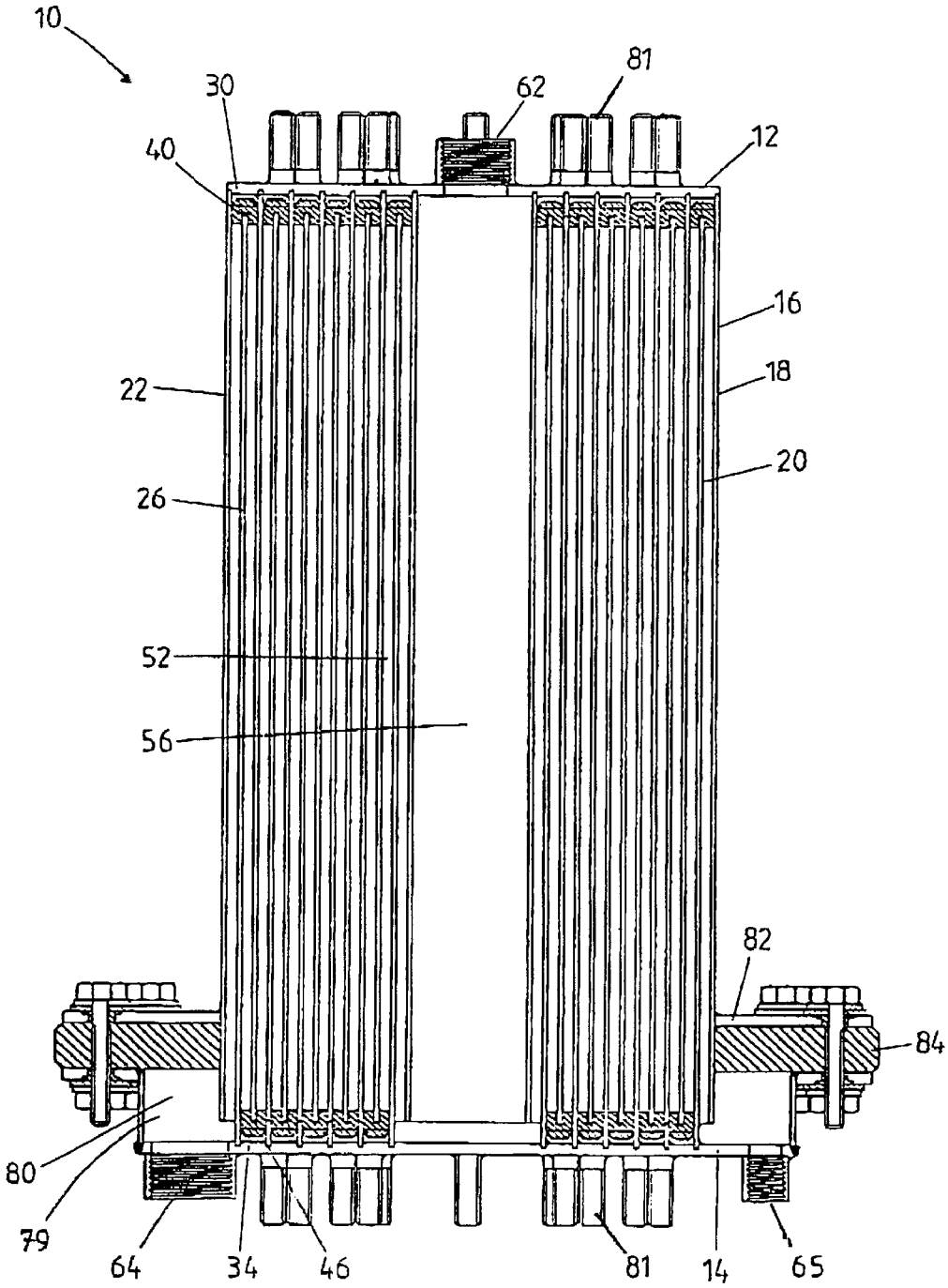
FIG. 9 is a side cross-sectional view of an alternate embodiment of an electrolytic cell in accordance with the present invention.
Figure 10:
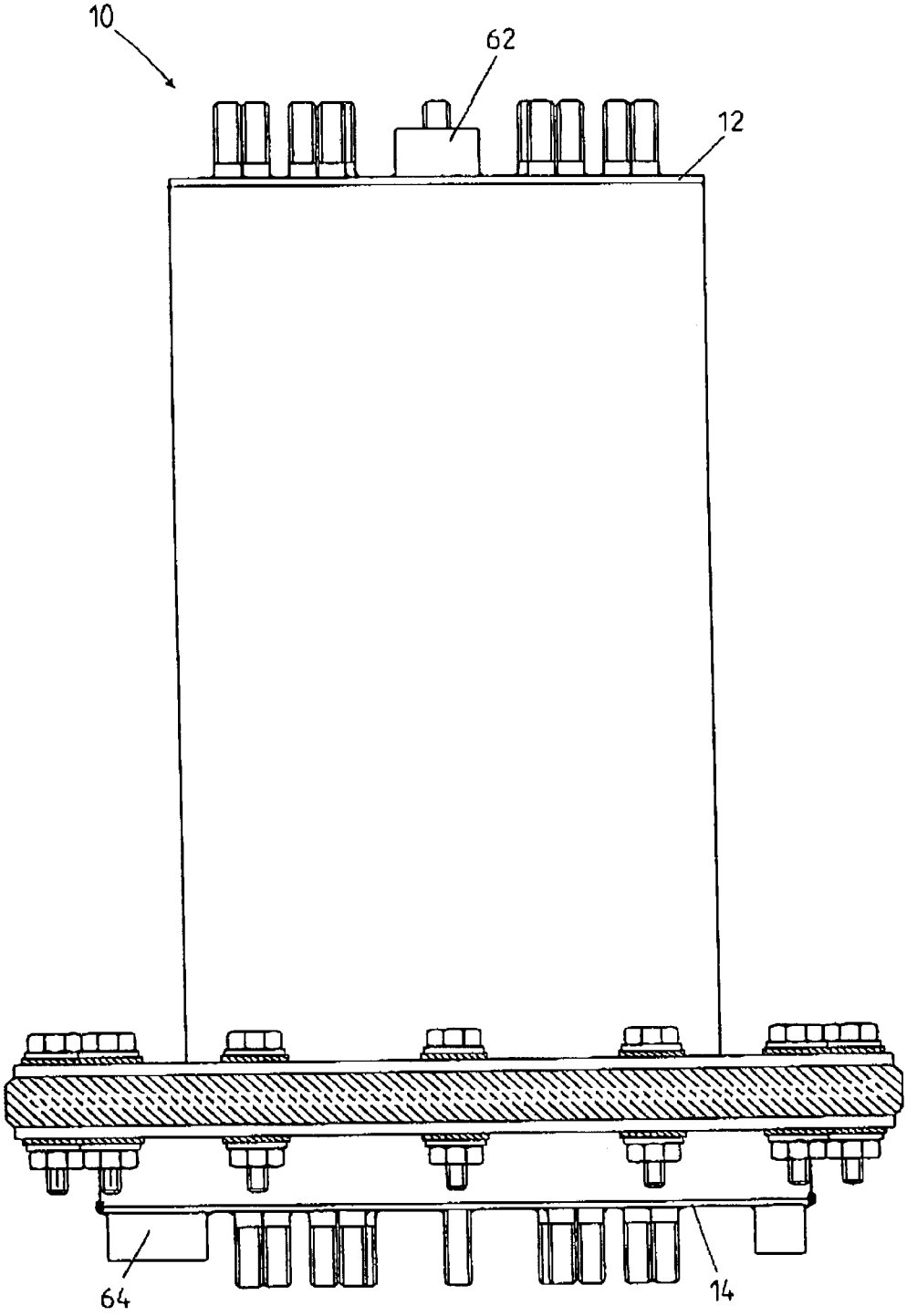
FIG. 10 is a side view of the electrolytic cell of FIG. 9.
Figure 11:
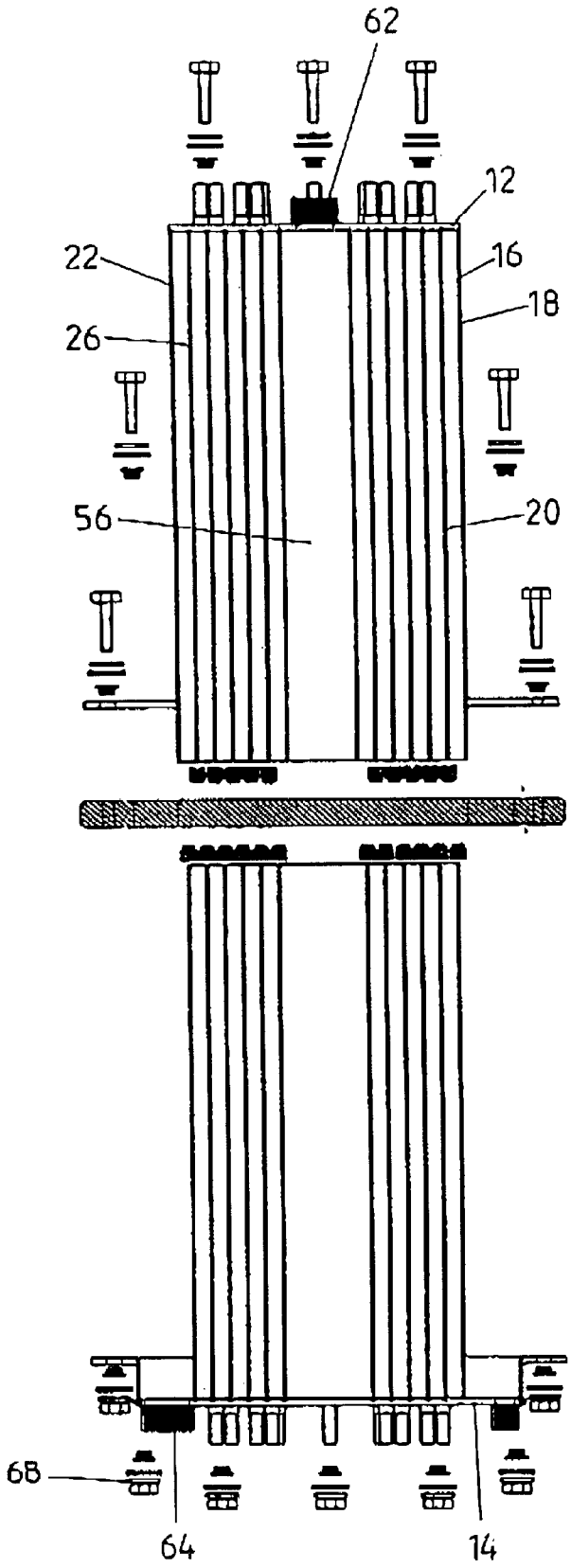
FIG. 11 is an exploded side cross-sectional view of the electrolytic cell of FIG. 9.
Figure 12:
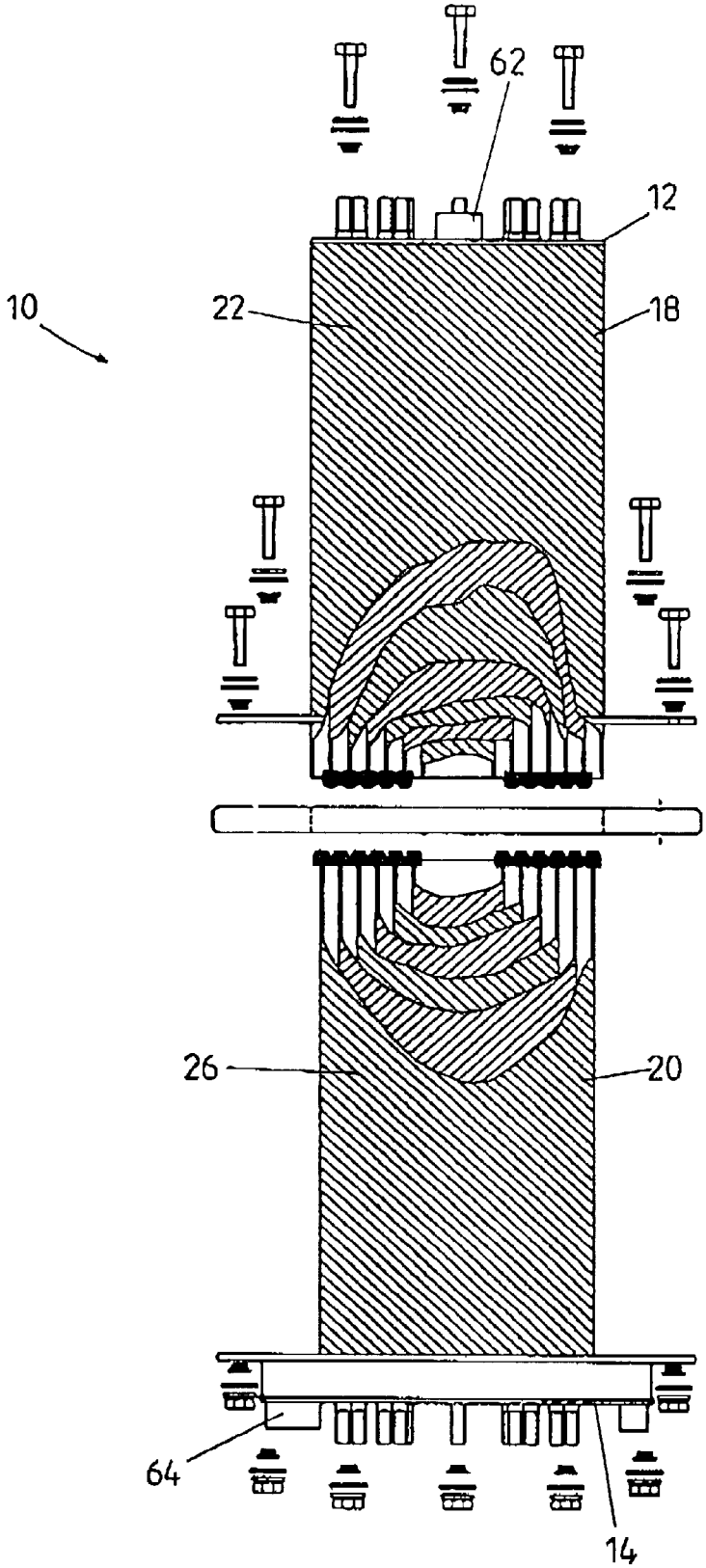
FIG. 12 is a side exploded view of the electrolytic cell of FIG. 9 with portions of the electrodes cut away.
Figure 13:
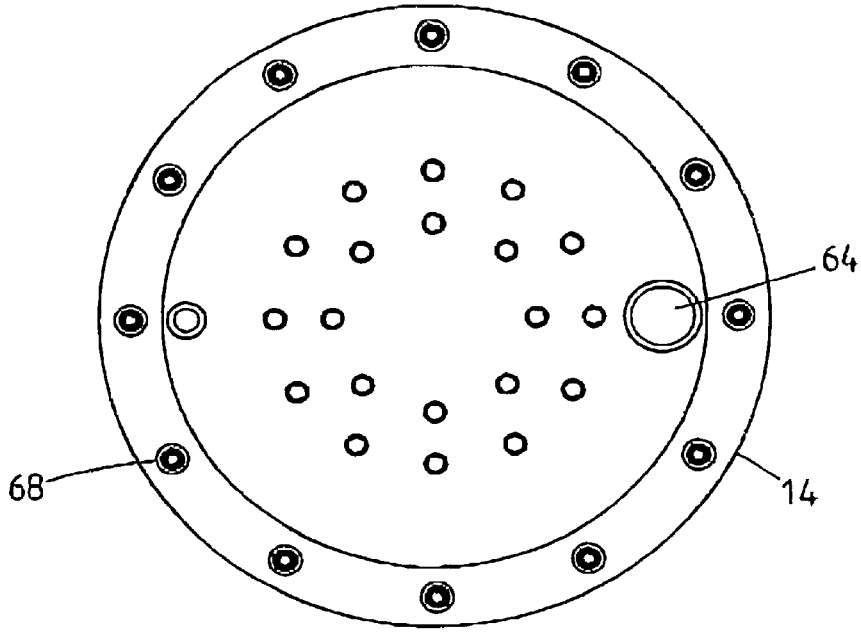
FIG. 13 is an end view of a first end of the electrolytic cell of FIG. 9.
Figure 14:
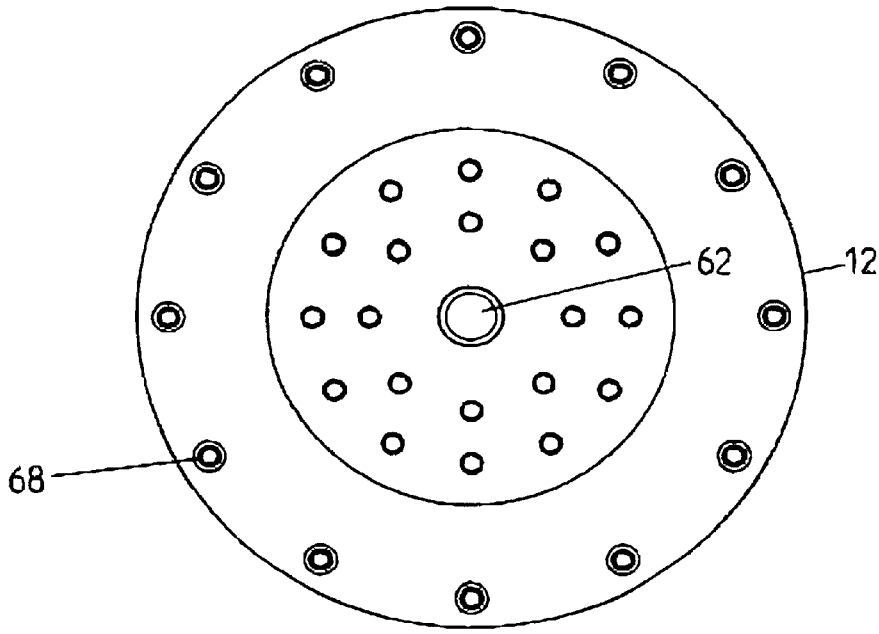
FIG. 14 is an end view of a second end of the electrolytic cell of FIG. 9.

In the embodiment shown in FIGS. 1 to 3, the electrolytic cell 10 includes four cathode tube members 22 and three anode tube members 26. The embodiment shown in FIGS. 4 to 8, shows an electrolytic cell 10 including three cathode tube members 22 and two anode tube members 26 and the embodiment in FIGS. 9 to 14 includes seven cathode tube members 22 and six anode tube members 26.

Referring to the embodiments shown in FIGS. 1 to 8, the electrolytic cell 10 includes a first outer spacer ring 28 and a plurality of first inner spacer rings 30. Also provided is a second outer spacer ring 32 and a plurality of second inner spacer rings 34. Further provided is a spacer disc 36. Each of the spacer rings 28, 30, 32 and 34 and the spacer disc 36 are made from an electrically insulating material, preferably PVC.

The first outer spacer ring 28 is arranged to be located around an outermost cathode tube member 22 adjacent the negative end flange member 12. The first outer spacer ring 28 includes a circular groove 38 adjacent its periphery. The first inner spacer rings 30 are arranged to be inserted between each cathode tube member 22 and an adjacent cathode tube member 22, adjacent the negative end flange member 12. Each first inner spacer ring 30 includes a circular groove 40.

The second outer spacer ring 32 is arranged to be located around an outermost anode tube member 26 adjacent the positive end flange member 14. The second outer spacer ring 32 includes a circular groove 42 adjacent its periphery. The second outer spacer ring 32 further includes a circular groove 44 adjacent an inner edge. The second inner spacer rings 34 are arranged to be inserted between each anode tube member 26 and an adjacent anode tube member 26, adjacent the positive end flange member 14. Each second inner spacer ring 34 includes a circular groove 46. The spacer disc 36 is arranged to be inserted within an innermost anode tube member 26 adjacent the positive end flange member 14. The spacer disc 36 includes a groove 48 adjacent its periphery.

The anode tube members 26 and cathode tube members 22 are arranged such that each anode tube member 26 may be received in the annular space between a pair of adjacent cathode tube members, as shown in FIG. 2. A second end of each anode tube member 26 is received within the groove 40 in a corresponding first spacer ring 30.

A second end of the outermost cathode tube member 22 is received within the groove 44 in the second outer spacer ring 32. A second end of the innermost cathode tube member 22 is received within the groove 48 in the spacer disc 36. Second ends of each inner cathode tube member 22 are received within the groove 46 in a corresponding second spacer ring 34.

The electrolytic cell 10 is further provided with a tubular casing member 50. A first end of the tubular casing member 50 is arranged to be received within the groove 38 in the first outer spacer ring 28. A second end of the tubular casing member 50 is arranged to be received within the groove 42 in the second outer spacer ring 32.

The arrangement of the electrodes 16 defines a plurality of annular channels 52 defined by the space between each adjacent cathode tube member 22 and anode tube member 26. Also included is an outer annular channel 54 defined by the space between the outermost cathode tube member 22 and the tubular casing member 50. An inner channel 56 is defined by the space within the innermost cathode member 22. Each cathode tube member 22 is provided with a first opening 58 adjacent the second end thereof and each anode tube member 26 is provided with a second opening 60 adjacent a second end thereof, as can be seen in FIG. 3.

The negative end flange member 12 has a first aperture 62 in fluid communication with the inner channel 56. The positive end flange member 14 has a second aperture 64 in fluid communication with the outer annular channel 54.

The electrolytic cell 10 further includes a plurality of securing rods 66. The securing rods 66 are inserted through holes in the negative end flange member 12 and corresponding holes in the positive end flange member 14 and secured by securing nuts 68.

A shorting ring 70 is secured to each of the negative and positive end plates 12 and 14 through which voltage is supplied. The shorting rings are preferably of copper and are used for enhanced current distribution. The end flanges 12 and 14 are preferably of hastelloy C.

Further, the electrolytic cell 10 includes isolating valves (not shown) adjacent first and second apertures 62 and 64 so that the cell may be isolated for maintenance.

FIGS. 9 to 14 show an alternate embodiment of an electrolytic cell 10 accordance with the present invention where like numerals denote like parts. The electrolytic cell 10 includes a positive end flange member 14 having an annular recess 79 around the outermost anode tube member 26 in fluid communication with the opening 64. A flange member 82 with a sealing ring 84 is provided about the outermost cathode tube member 22 such that when the electrolytic cell is assembled, the flange member 82 and sealing ring 84 cover the annular recess 79 in the positive end flange member 14 to define an annular cavity 80.

In use, the second end of the outermost cathode tube member 22 is not received within a second outer spacer ring but is received within the annular cavity 80 such that the outermost channel 52 is in fluid communication with the annular cavity 80.

The water flowing along the outermost annular channel 52 therefore flows out of the open end of the outermost cathode tube member 22 and out of the second aperture 64 and a third aperture 65 via the annular cavity 80. In this embodiment, the outer casing 50 is no longer required.

A plurality of threaded studs 81 are secured to the outer face of the negative and positive end flange members 12 and 14 by any suitable method, such as welding. The threaded studs protrude through positive and negative copper busbars (not shown) and are secured by threaded nuts to evenly distribute the electrical current into the positive and negative end flange members 12 and 14.

In use, the electrolytic cell 10 is assembled as described above and the negative and positive end flange members 12 and 14 are supplied with a suitable potential. Salt water is supplied to the cell through first aperture 62 and flows through the inner channel 56 generally toward the positive end flange member 14. The salt water flow passes through the first opening 58 in the innermost cathode tube member 22 and then flows generally toward the negative end flange member 12 along the innermost annular channel 52. The salt water then continues through successive annular channels 52 via openings 58 and 60 until it emerges into outer annular channel 54 and subsequently passes out of the cell through opening 64. Electrolysis occurring throughout the flow results in a solution containing sodium hypochlorite emerging from the cell 10 at opening 64.

Due to the arrangement of the electrodes within each other, an electrolytic cell 10 results which is physically small in size while retaining a long residence time of the salt water solution between anodes and cathodes. The increase in cross-sectional area of the annular channels 52 also results in a lower electrolyte velocity towards the outer channels which has the advantage of increasing the residence time of the solution in proximity to the electrodes as the solution becomes more depleted.

The arrangement of having the water flow in alternating directions along the cell between shorter parallel electrodes connected from opposite ends causes an equal and opposite voltage drop, resulting in a more uniform current density over all the surfaces of the electrodes than would be the case where a single pair of electrodes connected from the same end were used. Feeding the positive and negative polarities from opposed physical ends results in an even current density over all the anode and cathode surfaces due to the opposed voltage gradients. This results in an even wear of the mixed metal oxides of platinum coating the anodes.

The construction also results in a cell which can be assembled and disassembled without the need for specialized tools. Further, if renewal of the coating of mixed metal oxides of the platinum group of metals is required, the positive end flange which includes the anode tube members can be removed and sent for replating, without the need for sending the whole electrolyte cell.

Modifications and variations as would be apparent to a skilled addressee are deemed to be within the scope of the present invention. For example, the number of electrodes contained within the electrolytic cell may be varied or the polarities of the end flange members may be reversed. Also the arrangement shown in the Figures in which both of the outermost electrodes are cathodes may be altered such that one or both is an anode.

What is claimed is:

1. An electrolytic cell comprising a plurality of electrodes, the electrodes being tube members of increasing cross-sectional area arranged coaxially and being alternately cathode members and anode members, the tube members defining a plurality of annular channels between adjacent tube members, wherein each annular channel is in fluid communication adjacent a first end thereof with a first adjacent annular channel and is in fluid communication adjacent a second end thereof with a second adjacent annular channel.

2. An electrolytic cell in accordance with claim 1, wherein each cathode member is provided with a first opening adjacent an end thereof and each anode member is provided with a second opening adjacent an end thereof remote from the first opening.

3. An electrolytic cell in accordance with claim 1, wherein the cathode members are secured at a first end thereof to a negative end flange member and the anode members are secured at a first end thereof to a positive end flange member.

4. An electrolytic cell in accordance with claim 3, wherein a plurality of first spacer members are provided adjacent the negative end flange member arranged to receive second ends of the anode members such that the anode members are electrically insulated from the negative end flange member and a plurality of second spacer members are provided adjacent the positive end flange member arranged to receive second ends of the cathode members such that the cathode members are electrically insulated from the positive end flange member.

5. An electrolytic cell in accordance with claim 3, wherein an inlet is provided in either the negative end flange member or the positive end flange member and an outlet is provided in either the negative end flange member or the positive end flange member, the inlet being in fluid communication with a space defined by an innermost electrode and the outlet being in fluid communication with an outermost channel.

6. An electrolytic cell in accordance with claim 5, wherein an outer casing is provided around the electrodes between the negative end flange member and the positive end flange member, the outer casing defining an outer annular volume in fluid communication with the outlet.

7. An electrolytic cell in accordance with claim 5, wherein the negative end flange member or positive end flange member includes an annular cavity in fluid communication with the outermost channel, the annular cavity also being in fluid communication with the outlet.

8. An electrolytic cell in accordance with claim 3, wherein the negative end flange member and positive end flange member are each provided with a shorting ring via which voltage is applied.

9. An electrolytic cell in accordance with claim 3, wherein the negative end flange member and the positive end flange member are of hastelloy C.

10. An electrolytic cell in accordance with claim 1, wherein the anodes are titanium plated with mixed metal oxides of the platinum group of metals and the cathodes are unplated titanium.

* * * * *